US005469657A

United States Patent [19]

Drew

[11] Patent Number: 5,469,657

[45] Date of Patent: Nov. 28, 1995

[54] SECURITY-TRANSFER SYSTEMS

[76] Inventor: Roger C. Drew, 10 Elizabeth Close, Wendover Park, Aylesbury HP21 9XX, England

[21] Appl. No.: 199,671

[22] Filed: Feb. 22, 1994

[30] Foreign Application Priority Data

Feb. 23, 1993 [GB] United Kingdom ..... 9303626
Oct. 19, 1993 [GB] United Kingdom ..... 9321553

[51] Int. Cl.[6] ..... E06B 7/00

[52] U.S. Cl. ..... 49/68; 292/45

[58] Field of Search ..... 292/45, 44, DIG. 21; 109/6, 7, 67, 68; 49/68

[56] References Cited

U.S. PATENT DOCUMENTS

| | | | |
|---|---|---|---|
| 550,810 | 12/1895 | Winkopp | 49/68 |
| 3,174,193 | 3/1965 | Smith | 49/68 |
| 3,669,038 | 6/1972 | Watson | 49/68 X |
| 3,826,520 | 7/1974 | Ross et al. | 49/68 X |
| 4,011,686 | 3/1977 | Jett, III et al. . | |
| 4,741,275 | 5/1988 | Lewiner et al. | 109/7 |
| 5,311,166 | 5/1994 | Frye | 109/6 X |

FOREIGN PATENT DOCUMENTS

| | | | |
|---|---|---|---|
| 231520 | 1/1926 | United Kingdom | 292/DIG. 21 |
| 532536 | 1/1941 | United Kingdom . | |
| 1419382 | 12/1975 | United Kingdom . | |
| 1535636 | 12/1978 | United Kingdom . | |
| 2041053 | 9/1980 | United Kingdom . | |
| 2044327 | 10/1980 | United Kingdom | 49/68 |
| 2083549 | 3/1982 | United Kingdom . | |
| 2085962 | 5/1982 | United Kingdom . | |
| 2156427 | 10/1985 | United Kingdom . | |

*Primary Examiner*—Philip C. Kannan
*Assistant Examiner*—Jerry Redman
*Attorney, Agent, or Firm*—Davis, Bujold & Streck

[57] ABSTRACT

A security system controls two sliding (or other) doors 6 and 7 to allow only one door to be opened at a time. A pivoted bolt 13 is pushed by a mechanical link 16 into the opening-path of the door 6 when a lever 15 that abuts the leading-edge of the other door 7 pivots back upon opening movement of that door. A corresponding mechanism includes a link 26 which couples a pivoted bolt 23 to a lever 25 that abuts the door 6, such that the bolt 23 blocks opening of the door 7 when the door 6 begins to open. The mechanical links 16 and 26 may be replaced by hydraulic links.

10 Claims, 8 Drawing Sheets

10
11
II
13
6
12
25
1
9
8
II

SECURITY-TRANSFER SYSTEMS

BACKGROUND OF THE INVENTION

This invention relates to security-transfer systems.

The invention is particularly concerned with security systems of the kind in which two doors that provide access or transfer to a chamber or other area are interlocked with one another so that only one of the doors can be opened at any one time.

Security systems of the kind specified above are well-known and have found use in varied applications, ranging from the provision of air and light locks for rooms or containers, and the safe transfer of cash and other valuables, or persons, through a security barrier.

SUMMARY OF THE INVENTION

It is one of the objects of the present invention to provide a security system of the kind specified above, of improved form.

According to one aspect of the present invention there is provided a security system of the kind specified wherein the interlocking of the two doors involves two mechanisms each of which includes pivoted lever means that is arranged to be turned by a respective one of the doors upon opening movement of that door, and bolt means coupled to the ]ever means for obstructing opening of the other door in response to said turning of the lever means.

The bolt means of each said mechanism may be a bolt that is pivoted for movement between a position in which it is clear of the opening-path of said other door, and a position in which it projects into that path to obstruct opening of that door. More particularly, where the doors are sliding doors, the bolt means of the two mechanisms may each be a bolt that is mounted for pivotal movement into the path of the leading-edge of the respective door.

The lever means of each mechanism may be a pivoted lever that is urged resiliently into a rest position in which it is abutted by the door to be pivoted out of that position against the resilient bias as the door is opened. The lever may be coupled to the bolt means of such mechanism by an elongate link, and the resilient bias may be applied by a spring acting on the lever. As an alternative, the coupling between the bolt means and the lever means may be effected hydraulically.

Security systems in accordance with the present invention will now be described, by way of example, with reference to the accompanying drawings, in which:

DESCRIPTION OF THE PREFERRED EMBODIMENT(S)

Figure 1:
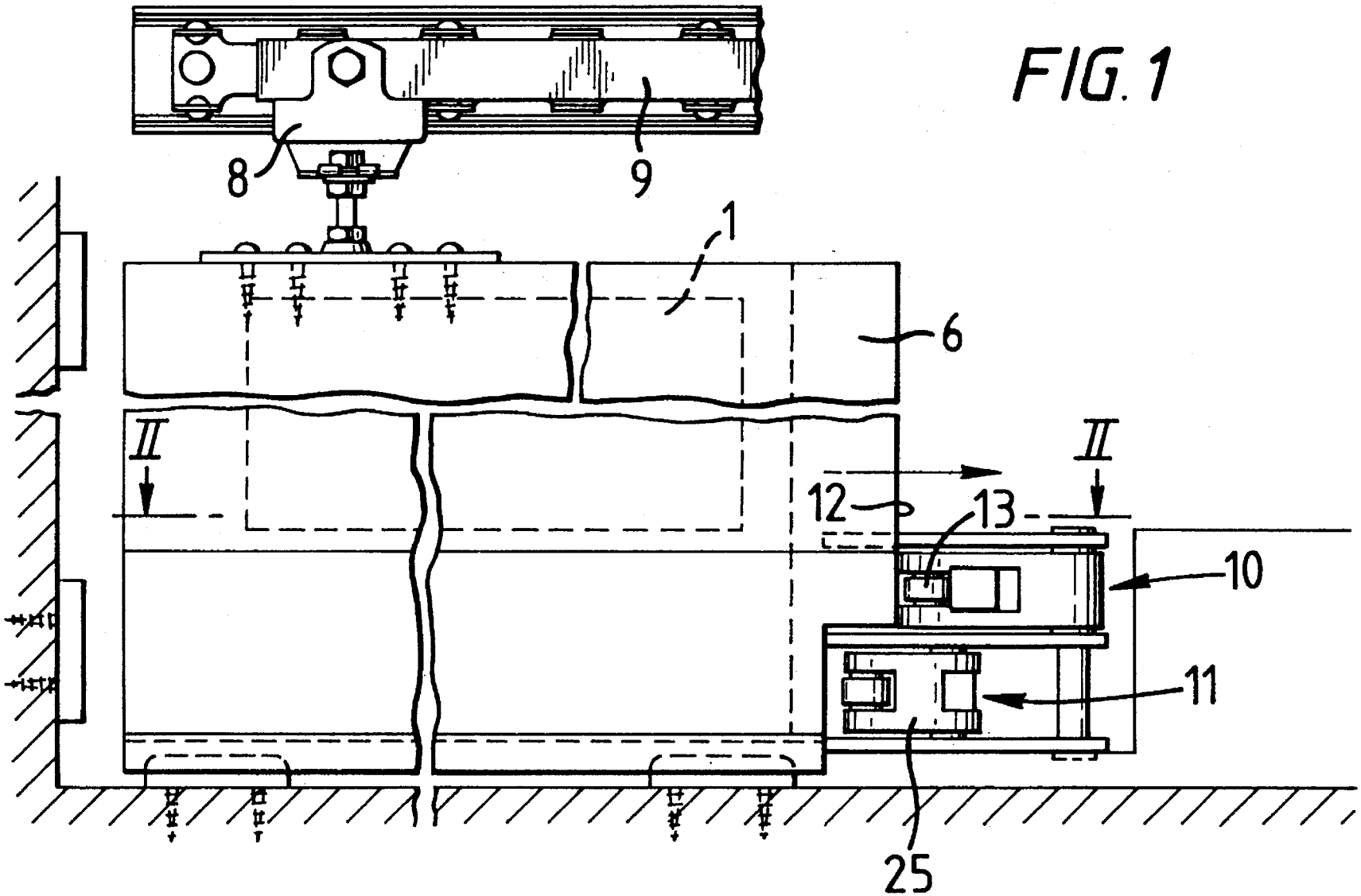
FIGS. 1 and 2 are, respectively a side elevation and a sectional plan of a first system in accordance with the present invention, when in the condition in which both of two doors are closed, the side-elevation of FIG. 1 being taken on the line I—I of FIG. 2, and the section of FIG. 2 on the line II—II of FIG. 1.
Figure 2:
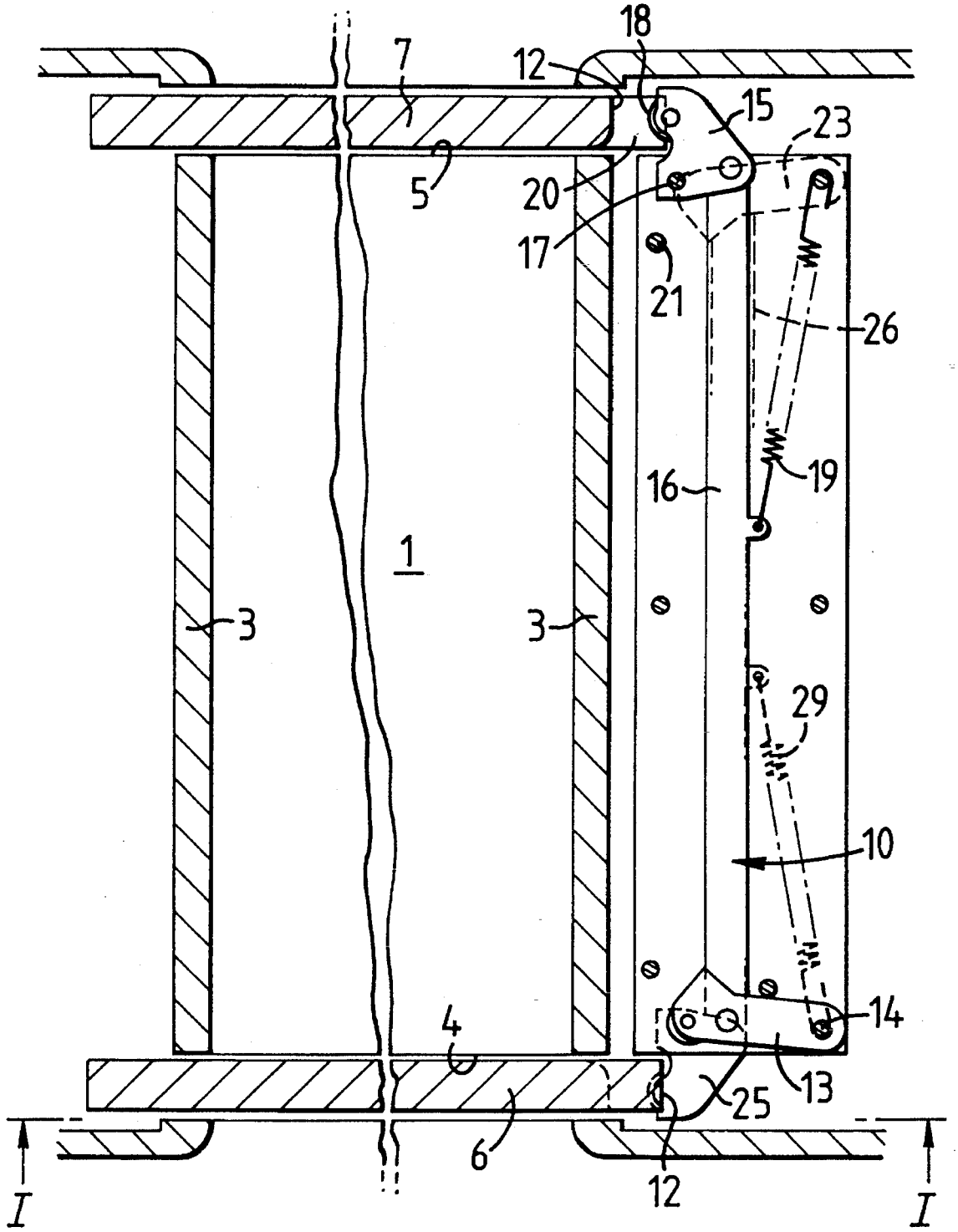

Referring to FIGS. 1 and 2, a transfer chamber 1 is defined within an open-ended rectangular box-structure that has two vertical side-walls 3 and is closed at its open ends 4 and 5 by sliding doors 6 and 7 respectively, The doors 6 and 7 are slidable between positions (as shown) in which they close their respective ends 4 and 5 of the chamber 1, and open positions in which access to the chamber 1 is enabled through those ends. More particularly, the door 6 is hung from a carriage 8 that runs along an elongate track 9 which extends horizontally above and beyond the end 4 so as to enable the closed door 6 to be slid to one side to uncover the open end 4; the door 7 is similarly hung at the end 5 to enable the closed door 7 to be slid to one side to afford access to the chamber 1 through the end 5.

An interlock is active between the two doors 6 and 7 to allow only one of the doors 6 and 7 to be opened at any one time. The interlock is effective to preclude the opening of either door 6 and 7 until the other door is closed, and involves two identical mechanisms 10 and 11 that are mounted one above the other below floor-level of the chamber 1. Both mechanisms 10 and 11 interact with both doors 6 and 7, interaction with each door 6 and 7 being at the edge 12 that leads on opening.

Figure 3:
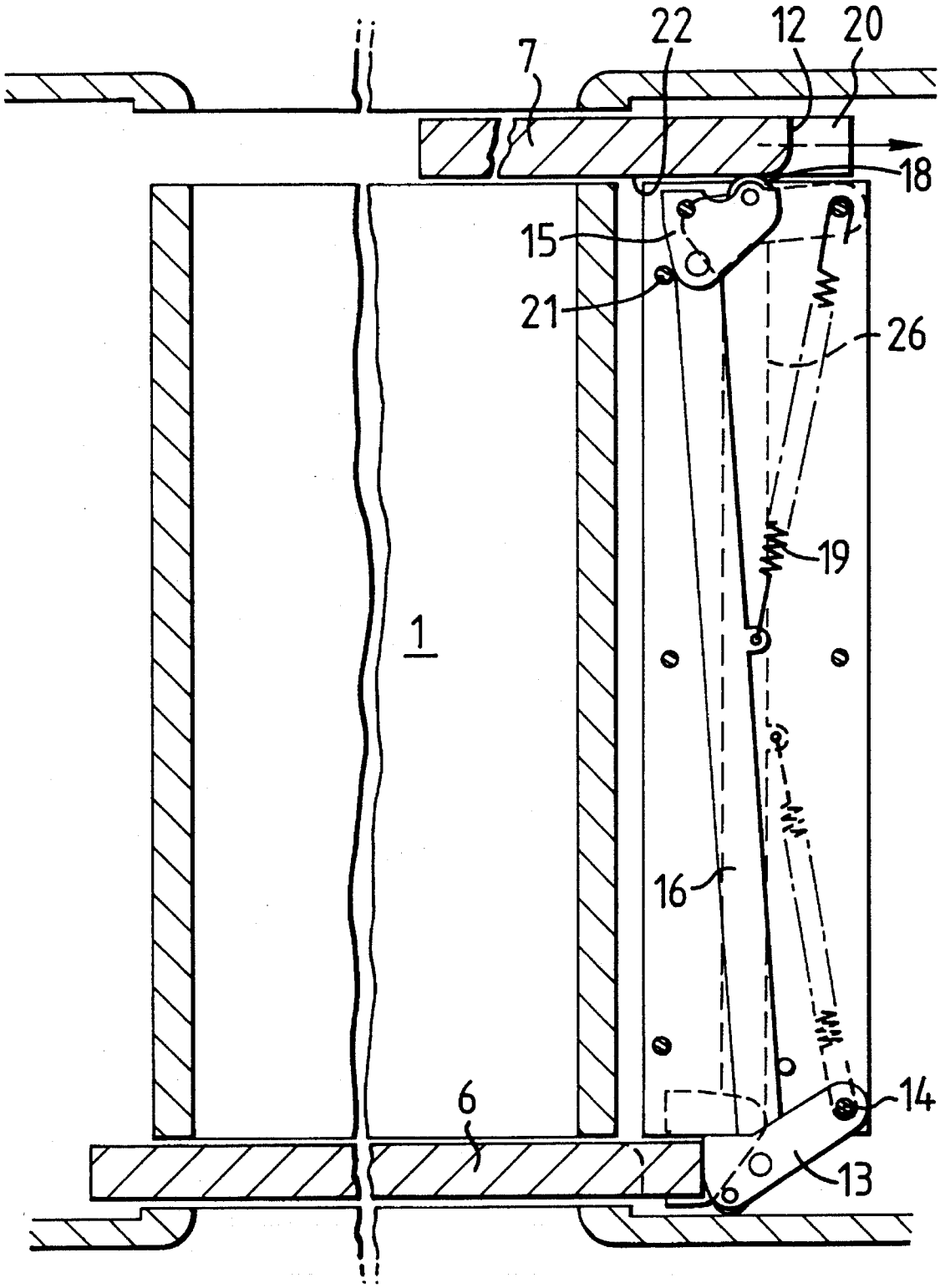
FIGS. 3 to 5 are sectional plan views of the system of FIGS. 1 and 2, FIG. 3 showing the condition when one of the doors is opened, FIG. 4 the condition when the other door is opened, and FIG. 5 a jammed condition which arises when attempt is made to open both doors together at the same time.

The mechanism 10 involves a bolt 13 that is mounted on a pivot 14 to swing between two positions, in one of which (as shown in FIG. 2) it is clear of the leading-edge 12 of the door 6 so as to allow the door 6 to open. In the other position, the bolt 13 is swung over into the path of the leading-edge 12 so as to block opening movement of the door 6. Movement of the bolt 13 between the two position is regulated by a jockey lever 15 that is adapted to ride on the door 7 and i coupled to the bolt 13 via a link 16 The lever 15 which is mounted on a pivot 17, carries a roller 18 and is urged by a spring 19 that acts on the link 16, to adopt a rest position about the pivot 17. In this rest position the roller 18 lies in the path of the leading-edge 12 within a cut-out 20 of the door 6, so that the leading-edge 12 within the cut-out 20 contacts the roller 18 as the door 7 is opened, turning the Jockey lever 15 back on its pivot 17 against the action of the spring The condition of the mechanism 10 that results for opening of the door 7 is illustrated in FIG. 3. As shown in FIG. 3, and in consequence of the contact of the leading-edge 12 of the door 7 with the roller 18 within the cut-out 20, the lever 15 is turned back towards a stop 21 such that the roller 18 now bears on the inside face 22 of the door 7, and the door 7 is free to be opened fully. With this turned-back orientation of the lever 15, however, the bolt 13 is turned on its pivot 14 via the link 16 into the position in which it blocks the door 6 from opening. The bolt 13 remains in this position while the door 7 remains open and until the door 7 is fully closed again to allow the jockey lever 15 to return to its rest position under the action of the spring 19, and restore the condition shown most clearly in FIG. 2.

Figure 4:
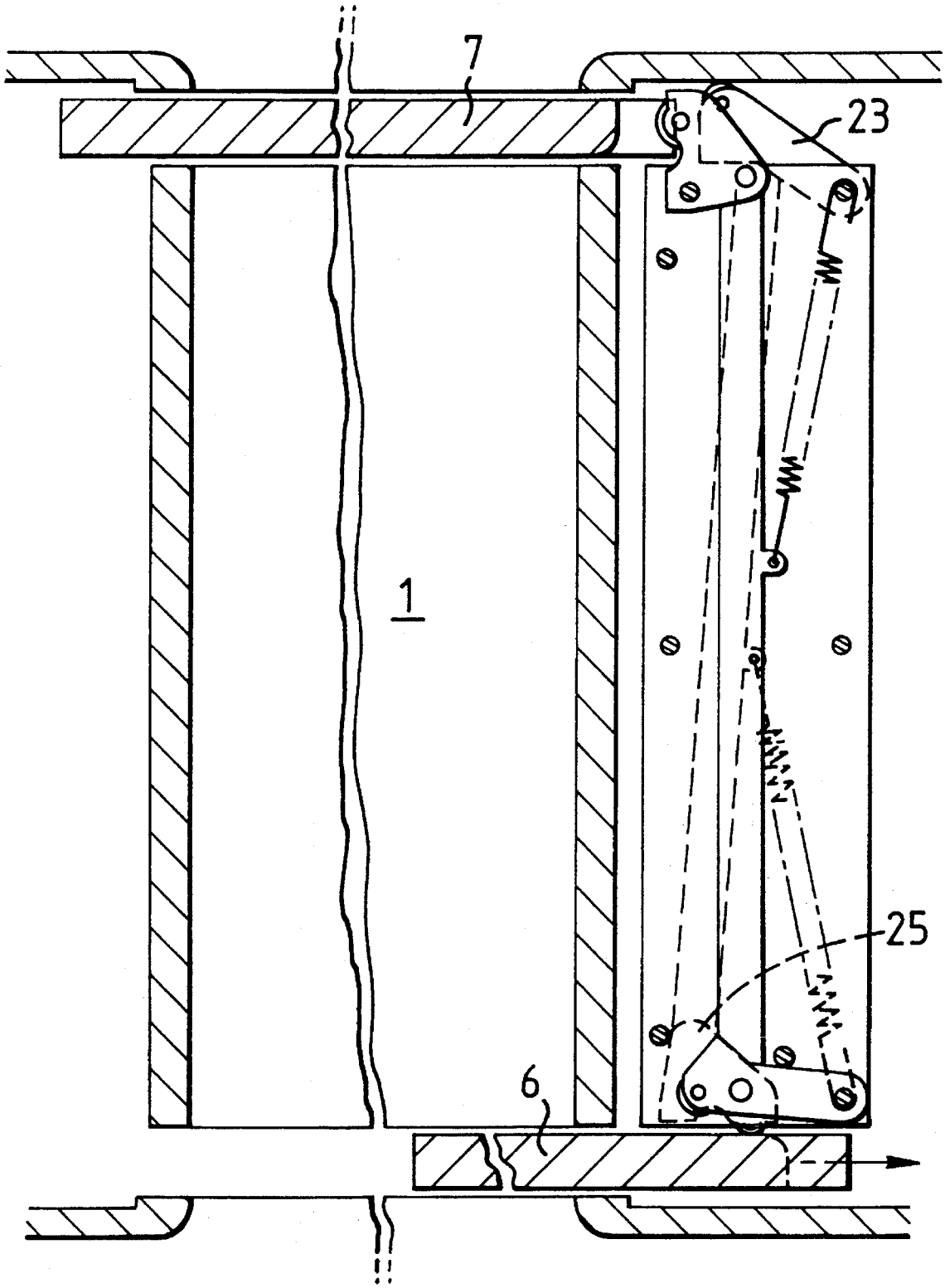

The mechanism 11 is the same as the mechanism 10 in its construction and action except that is bolt 23 is pivoted adjacent to the leading-edge 12 of the door 7, and its pivoted jockey lever 25, coupled through its link 26 to the bolt 23, is active at the leading-edge 12 of the door 6 under the action of its spring 29. The bolt 23 is clear of the leading-edge 12 of the door 7 while the door 6 is closed, but, as illustrated in FIG. 4, is swung over to block opening of the door 7 when the spring-biased lever 25 is turned back from its rest position in response to opening of the door 6.

Any attempt to open both doors 6 and 7 together at the same time, precludes the opening of either door. If in the attempt the opening of one of the doors 6 and 7 is slightly in advance of the opening of the other, that one door will open and the opening of the other will be blocked by the interlock provided by whichever of the mechanisms 10 or 11 first becomes active; the action will be as described above. However, if the doors 6 and 7 are moved together, the mechanisms 10 and 11 effectively jam both doors 6 and ? closed, as illustrated in FIG. 5.

Figure 5:
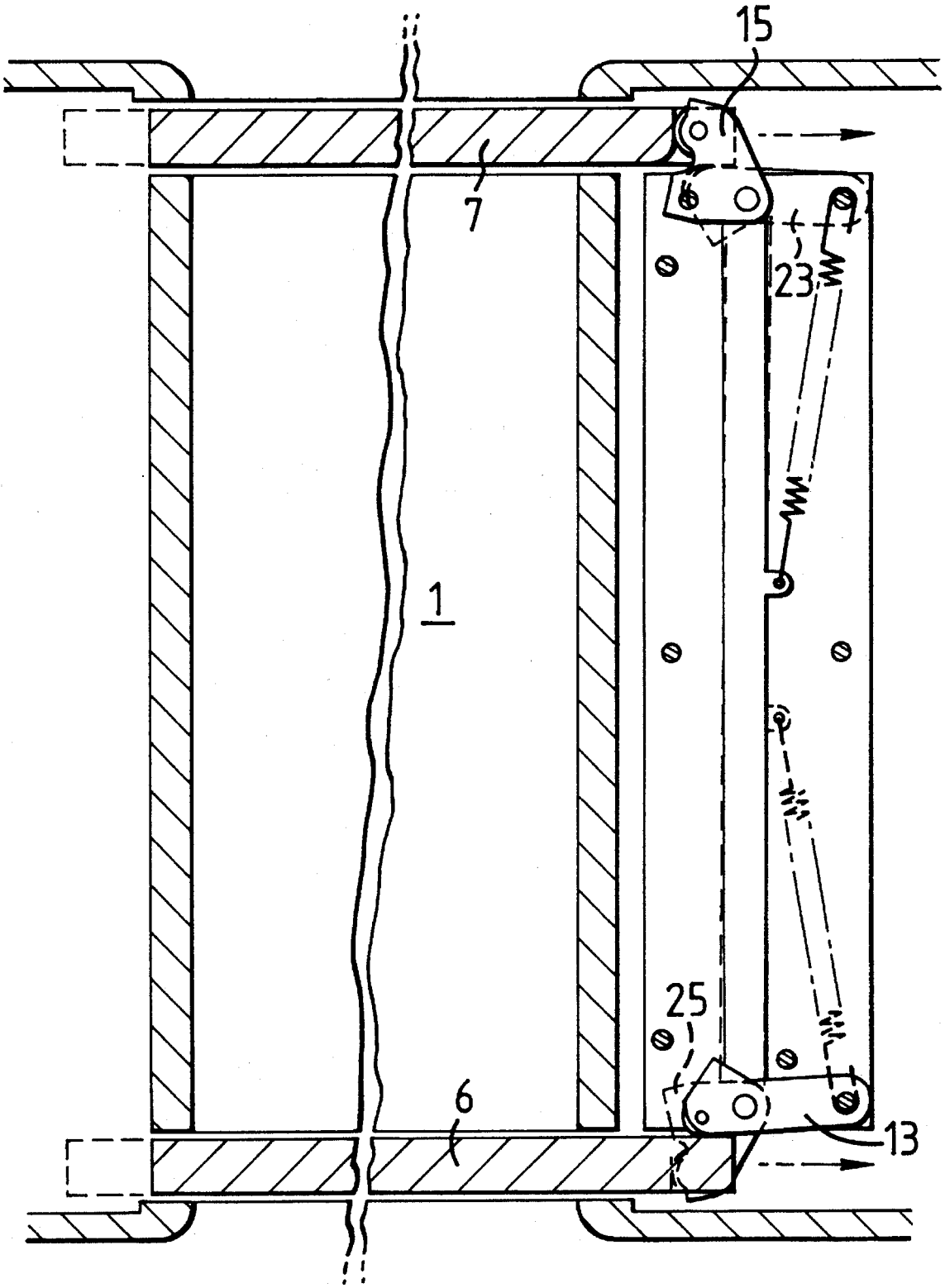

More particularly as illustrated in FIG. 5, the opening movement of the doors 6 and 7 block both bolts 13 and 23 from full pivotal movement, the bolt 13 being blocked by tho door 6 and the bolt 23 by the door 7. Accordingly, the jockey levers 15 and 25 are prevented from turning back significantly from their rest positions and accordingly block further opening movements of the doors 7 and 6 respectively. Both doors 6 and 7 are precluded from opening, and recovery from this jammed condition requires that at least one of the doors 6 and 7 is returned to its fully closed position to remove the obstruction to pivoting of one or the other of the bolts 13 and 23.

Although the use of the mechanical links 16 and 26 in the system described above, ensures direct, positive intercoupling of the bolts 13 ann 23 with the levers 5 and 25 respectively, positive coupling can be achieved in other ways. ID particular, the coupling can be usefully effected hydraulically as illustrated in FIGS. 6 and 7.

Figure 6:
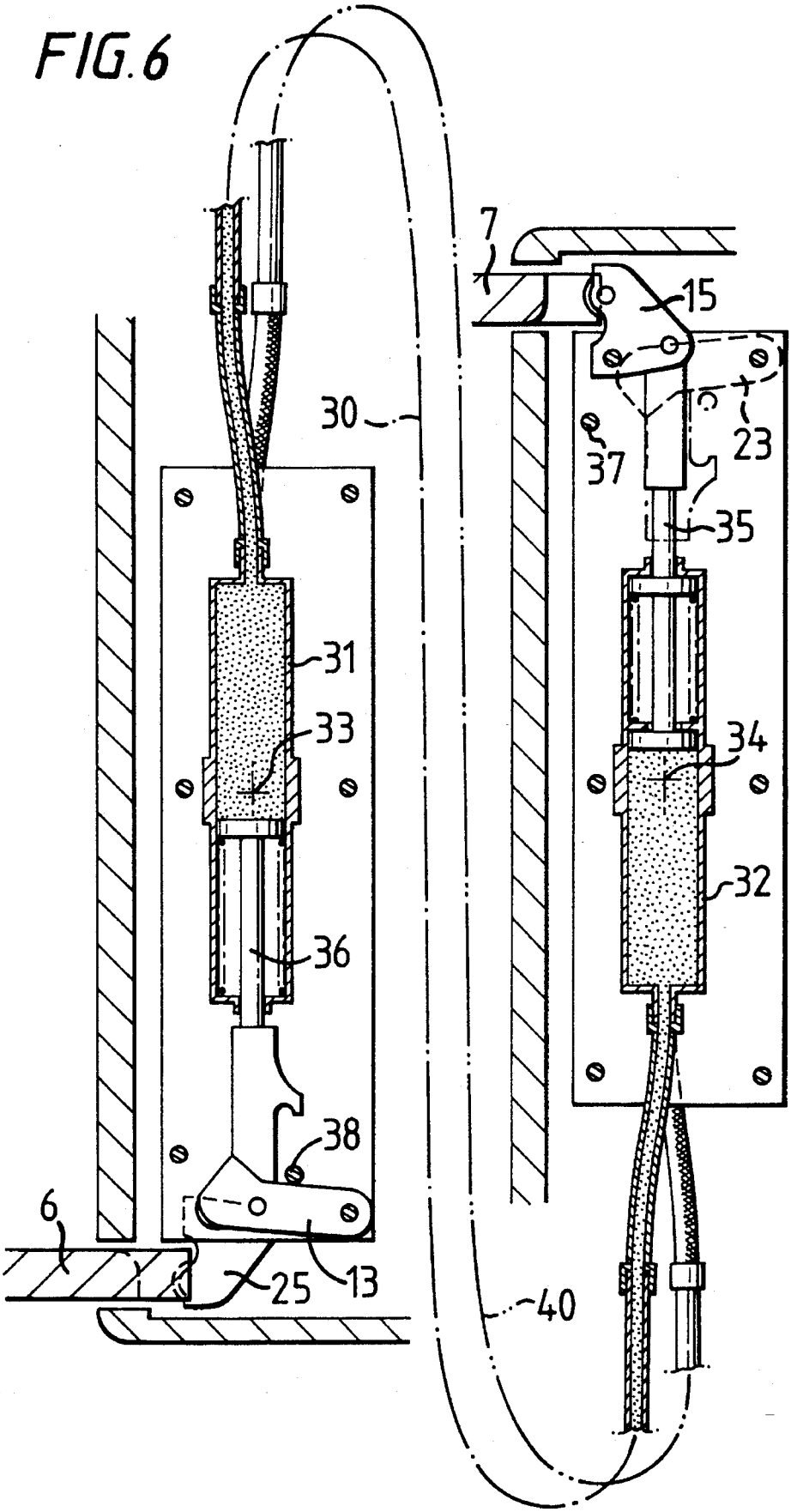
FIGS. 6 and 7 illustrate a modification of the system of FIGS. 1 to 5, using hydraulics.
Figure 7:
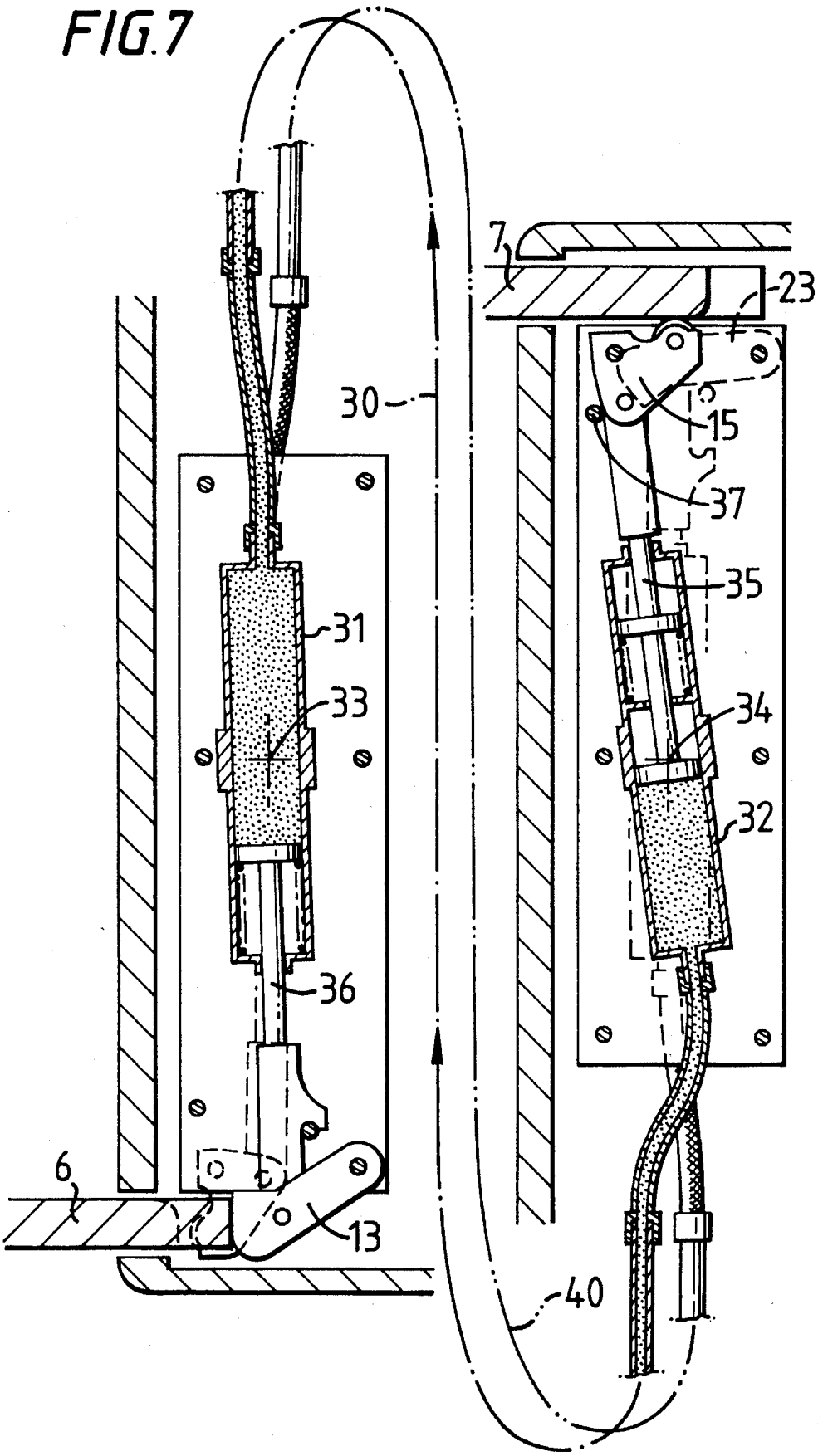

Referring to FIG. 6, the bolt 13 and lever 15 are in this case intercoupled by an hydraulic link 30 between hydraulic cylinders 3 and 32 coupled to the bolt 13 and lever 15 respectively. The cylinders 31 and 32 are mounted on pivot point 33 and 34, respectively, that allow them to turn slightly with the turning of their respective bolt 13 and lever The spring-biased piston 35 of the cylinder 32 is connected to the lever 15 so that as the lever 15 is deflected from the position illustrated in FIG. 6 with opening of the door 7, to the position illustrated in FIG. 7, the change is communicated from the cylinder 32 via the link 30 to the cylinder 31. The spring-biased piston 36 of the cylinder 31 accordingly drives the bolt 13 from the position of FIG. 6 to that of FIG. 7 in which opening of the door 6 i blocked. The extent of deflection of the lever 15 is limited by a stop 37, whereas the travel of the piston 36 is limited by a stop 38 which also serves to limit the extent of withdrawal (FIG. 6) of the bolt 13.

Closing of the door 7 allows the lever 15 to return to it undeflected position (FIG. 6) under the spring-bias exerted on the piston 35. The piston 36 is in consequence, via the link 30, drawn into the cylinder 31, withdrawing the bolt 13 until it reaches the stop 38.

The intercoupling of the bolt 23 at the door 7 with the lever 25 of the door 6, is essentially the same as that between the bolt 13 and lever 15, being in this case via an hydraulic link 40 between cylinders (not shown) corresponding to the cylinders 31 and 32. Deflection of the lever 25 in response to opening of the door 6 is sensed and communicated via the link 40 to turn the bolt 23 into the path of the door 7 and block its opening. Closing of the door 6 allows the lever 25 to return to its undeflected position, and this return communicated via the link 40 withdraws the bolt 23 from blocking opening of the door 7.

Thus, the hydraulic system of FIGS. 6 and 7 is essentially the same as that of FIGS. 1 to 5 in functional operation of allowing only one of the doors 6 and 7 to be open at any time. The use of hydraulics offers the advantages, however, that it enables the doors to be set further apart from one another and more readily set inclined to one another add at different levels. Moreover, it readily enables an override control to be included in the system; in particular, it is easily possible to introduce a facility for selectively breaking both hydraulic links 30 and 40 so as to allow both doors 6 and 7 to open independently of the other, in the event of fire or other emergency. Furthermore, it is readily possible to extend the system to cover more than two doors, by linking bolt actuation at each door hydraulically with the jockey levers of al other doors.

Figure 8:
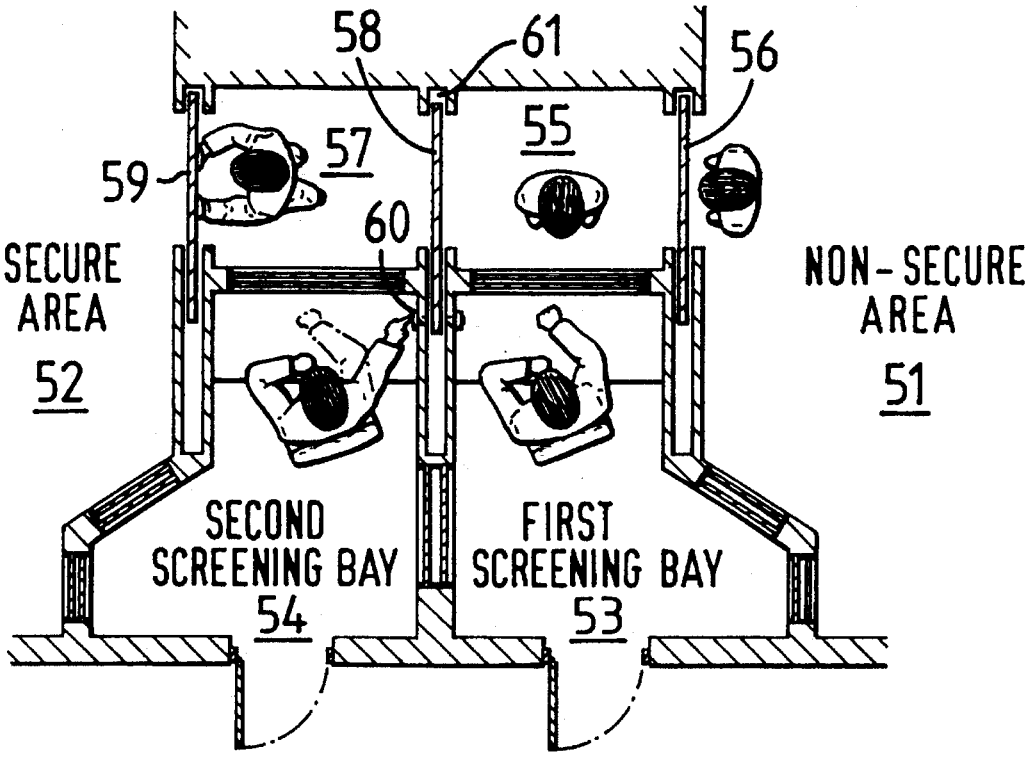
FIGS. 8 and 9 illustrate applications of the systems of FIG. 1 to 5 and FIGS. 6 and 7.
Figure 9:
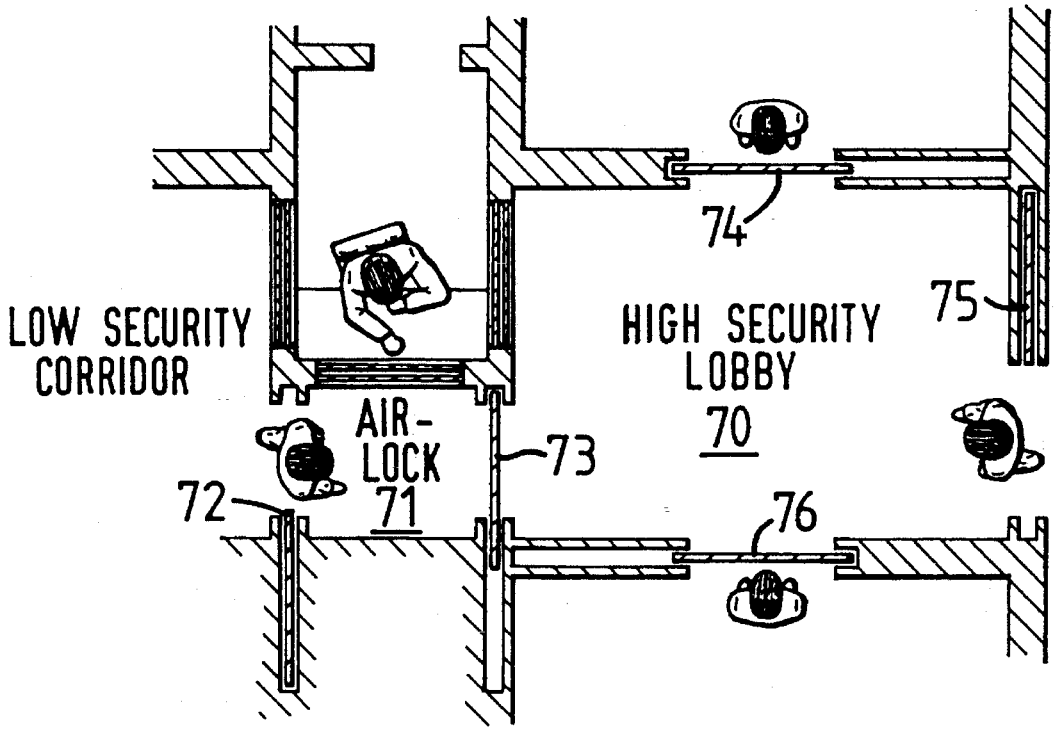

Applications of the interlock systems described above, for controlling access to and from a secure area, are illustrated in FIGS. 8 and 9, and will now be described.

Referring to FIG. 8, access for a person from an outside or non-secure area 51 to a secure area 52 is gained via two screening bays 53 and 54. Entry from the area 51 into the passage 55 of the first bay 53 is controlled by a sliding door 56, and from the passage 55 into the passage 57 of the second bay 54, by a sliding door 58. Finally, access from the passage 57 into the secure area 52 is controlled by a sliding door 59.

Two interlock systems (not shown) of the form described above with reference to FIGS. 1 to 5 or FIGS. 6 and 7 are operative between the three doors 56, 58 and 59, one between the pair of doors 56 and 58 and the other between the pair of doors 58 and 59. Thus, while the door 58 is open, neither door 56 and 59 can be opened, whereas the door 58 cannot be opened while either of the doors 56 and 59 is open. Opening of the door 58 accordingly provides effective control over the outermost and innermost doors 56 and 59, and this control is put to effective use in the arrangement of FIG. 8.

In the latter respect, the guards within the screening bays 53 and 54 overseeing the passages 55 and 57, are provided with a lock facility 60 that enables either of them to withdraw the door 58 slightly (as illustrated in FIG. 8) from its fully closed position and secure it there. The slight movement involved (for example of 10 mm to 15 mm) is insufficient to withdraw the leading edge of the door 58 clear of its frame recess 61, so it continues to block access between the passages 55 and 57. However, the movement is enough to actuate the interlock systems with the door 58, so neither door 56 and 59 can be opened. In this simple way therefore, either guard can lock all the doors 56, 58 and 59.

The arrangement of FIG. 8 could readily be extended to incorporate one or more further screening bays dividing off access to the secure area from the outside.

More complicated interlocking can be readily achieved as illustrated by FIG. 9.

Referring to FIG. 9, access to a high-security lobby 70 of a bank or other institution is gained via an "air-lock"0 passage 71 having outer and inner sliding-doors 72 and 73 that are interlocked by a system (not shown) such as described above with reference to FIGS. 1 to 5 (or FIGS. 6 and 7). Internal doors 74 to 76 to the lobby 70 are interlocked with one another and the door 73 using one or more hydraulic systems (not shown) of the nature described above with reference to FIGS. 6 and 7. Thus, while door 73 is open none of the doors 72 and 74 to 76 can be opened, and while door 72 is open, door 73 cannot be opened but any one, but only one, of the doors 74 to 76 can be opened.

Although the transfer installations described above involve sliding doors, the invention is applicable where other forms of door are involved; more particularly, hinged doors may be utilised. Hinged doors can indeed be readily provided within the context of the installations described above, simply by replacing the sliding doors by sliding screens into which the hinged doors are incorporated. In this respect, each door may be located in its respective sliding screen such that in the normal, "closed" position of the screen, the door is not aligned with the chamber and opening of it is obstructed, the door being aligned with the chamber and openable only when the screen has been slid to an "open" position.

What is claimed is:

1. A security system in which interlocking means is operative between two access doors to enable only one of the doors to be opened at any one time, each said door is a sliding door having a leading edge which leads in opening movement of the door, and said interlocking means comprises two mechanisms each of which includes:

(a) pivoted lever means for responding to movement of a respective one of the doors to turn upon opening movement of the respective door, and (b) bolt means, coupled to the pivoted lever means, for responding to turning of the pivoted lever means to obstruct opening of the other door, the bolt means comprising a pivoted bolt that is pivoted for movement between a position in which it is clear of an opening path of said other door and a position in which it projects into that path to obstruct opening of said other door, said bolt means including means mounting the pivoted bolt for pivotal movement into the path of the leading edge of said other door.

2. A security system in which interlocking means is operative between two access doors to enable only one of the doors to be opened at any one time, said interlocking means comprises two mechanisms each of which includes pivoted lever means for responding to movement of a respective one of the doors to turn upon opening movement of that door, and bolt means, coupled to the pivoted lever means, for responding to turning of the pivoted lever means to obstruct opening of the other door, each said mechanism comprising:

(a) a pivoted lever having first and second pivotal positions;

(b) a pivoted bolt having a withdrawn position and a door-blocking position;

(c) a hydraulic sensor coupled to the pivoted lever for sensing pivotal movement of the pivoted lever from its first position, the hydraulic sensor comprising a first hydraulic cylinder and a spring-biased piston for sliding within the first cylinder;

(d) a hydraulic driver intercoupled with the sensor to drive the pivoted bolt from its withdrawn position to its door-blocking position in response to pivotal movement of the pivoted lever from its first position to its second position, the hydraulic driver comprising a second hydraulic cylinder and a spring-biased piston for sliding within said second cylinder; and (e) means for biasing the pivoted lever into its said first position.

3. A security system in which interlocking means is operative between two access doors to enable only one of the doors to be opened at any one time, said interlocking means comprises two mechanisms each of which comprises:

(a) a pivoted lever for responding to movement of a respective one of the doors to pivot from a rest position in response to opening movement of said one door;

(b) bolt means for blocking opening movement of the other door, said bolt means including a pivoted bolt mounted for pivotal movement between a withdrawn position in which it is clear of an opening path of said other door and a door-blocking position in which it projects into the opening path of said other door to obstruct opening of said other door; and (c) coupling means for coupling said bolt means to the pivoted lever to move the bolt into said door-blocking position in response to pivoting of the pivoted lever from its said rest position.

4. A security system according to claim 3 wherein said coupling means comprises a hydraulic system intercoupling the bolt means with the pivoted lever.

5. A security system according to claim 3 including means for exerting resilient bias to urge the pivoted lever into abutment with said one door, and wherein the bias opposes turning movement of the pivoted lever from its said rest position.

6. A security system according to claim 3 wherein said coupling means comprises an elongate link member that intercouples the pivoted bolt with the pivoted lever.

7. A security system according to claim 6 wherein the pivoted lever is coupled pivotally to one end of the elongate link member, and the pivoted bolt is coupled pivotally to the other end of the elongate link member.

8. A security system in which interlocking means is operative between two access doors to enable only one of the doors to be opened at any one time, said interlocking means comprises two mechanisms which each comprise:

(a) a jockey lever for riding on a respective one of the doors, the jockey lever being pivoted to adopt a rest position in relation to said one door when said one door is closed and to pivot from said rest position upon opening movement of said one door;

(b) means for resiliently biasing the jockey lever into said rest position;

(c) a bolt pivoted at a location spaced from the pivoting of the jockey lever, said bolt being pivoted for pivotal movement from a withdrawn position into a door-blocking position in which it blocks opening of the other door; and (d) means coupled to the pivoted bolt for sensing pivoting of the jockey lever from said rest position to drive the pivoted bolt from its withdrawn position to its door-blocking position.

9. A security system according to claim 8 wherein said means coupled to the pivoted bolt is a mechanical link between the jockey lever and the pivoted bolt to pivot the pivoted bolt into its door-blocking position upon pivotal movement of the jockey lever from its said rest position.

10. A security system according to claim 8 wherein said means coupled to the pivoted bolt comprises a hydraulic link between the jockey lever and the pivoted bolt, said hydraulic link being operative to pivot the pivoted bolt into its door-blocking position upon pivotal movement of the jockey lever from its said rest position.

* * * * *